US008459643B2

(12) United States Patent
Cheng

(10) Patent No.: US 8,459,643 B2
(45) Date of Patent: Jun. 11, 2013

(54) PRINTING APPARATUS

(75) Inventor: Fei Cheng, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/356,442

(22) Filed: Jan. 23, 2012

(65) Prior Publication Data

US 2012/0248694 A1 Oct. 4, 2012

(30) Foreign Application Priority Data

Mar. 28, 2011 (JP) ..... 2011-069586

(51) Int. Cl.
*B65H 39/10* (2006.01)

(52) U.S. Cl.
USPC ..... 271/288; 271/298

(58) Field of Classification Search
USPC ..... 271/288, 298
See application file for complete search history.

(56) References Cited

U.S. PATENT DOCUMENTS

| | | | | |
|---|---|---|---|---|
| 4,501,419 | A * | 2/1985 | Takahashi et al. | 271/288 |
| 6,988,728 | B2 * | 1/2006 | Kida | 271/292 |
| 8,235,387 | B2 * | 8/2012 | Tanaka | 271/288 |
| 2011/0175284 | A1 * | 7/2011 | Tanaka | 271/288 |

FOREIGN PATENT DOCUMENTS

| | | | |
|---|---|---|---|
| JP | H07-010344 | A | 1/1995 |
| JP | H10-087154 | A | 4/1998 |
| JP | H10-273261 | A | 10/1998 |
| JP | 2001-042749 | A | 2/2001 |

OTHER PUBLICATIONS

Japan Patent Office, Notice of Reasons for Rejection of Japanese Patent Application No. 2011-069586 (counterpart to above-captioned patent application), mailed Apr. 2, 2013.

* cited by examiner

*Primary Examiner* — Luis A Gonzalez
(74) *Attorney, Agent, or Firm* — Baker Botts L.L.P.

(57) ABSTRACT

There is provided a printing apparatus including: a printing mechanism; a plurality of trays; a discharge mechanism; a plurality of detection mechanisms which detect whether a height of the sheets stacked on the trays is not less than a threshold value; and a controller which controls the discharge mechanism and the printing mechanism. When the detection mechanisms detect that all heights of the sheets stacked on the trays are not less than the threshold value, the controller controls the discharge mechanism to discontinue a discharge of the sheets. After the discharge of the sheets is discontinued, when the detection mechanisms detect that the heights of the sheets stacked on at least two trays became smaller than the threshold value, the controller controls the discharge mechanism to resume the discharge of the sheets on a tray which is other than a tray which is recovered last.

13 Claims, 8 Drawing Sheets

PRINTING APPARATUS

CROSS REFERENCE TO RELATED APPLICATION

The present application claims priority from Japanese Patent Application No. 2011-069586, filed on Mar. 28, 2011, the disclosure of which is incorporated herein by reference in its entirety.

BACKGROUND OF THE INVENTION

1. Field of the Invention

The present invention relates to a printing apparatus, and in particular, to a printing apparatus which is provided with a plurality of mounting mechanisms on which a plurality of recording media subjected to printing can be placed.

2. Description of the Related Art

Japanese Patent Application Laid-Open No. H07-10344 discloses a printing apparatus which is provided with a plurality of paper discharge trays and which performs a link-tray process in which when any error occurs in the paper discharge tray being used, printing is continued by performing the paper discharge on the other paper discharge tray. The link-tray process is configured as follows. That is, when there is no paper discharge tray on which the paper discharge can be performed and when the errors occur in all of the paper discharge trays, the printing is discontinued and is made to wait until the one of the errors is cleared.

SUMMARY OF THE INVENTION

According to the printing apparatus disclosed in Japanese Patent Application Laid-Open No. H07-10344, for example, when a user removes only a part of recording media from the paper discharge tray having the error, the error of said paper discharge tray is cleared and the paper discharge is resumed. This may prevent from the user from removing a remaining part of recording media and may bring about any unfavorable influence on the user's work.

The present teaching has been made in order to solve the problem as described above, and an object of which is to provide a printing apparatus which makes it possible to resume printing without causing any unfavorable influence on a user's work for clearing a paper discharge error.

According to a first aspect of the present teaching, there is provided a printing apparatus which performs a printing on a plurality of sheets, including:

- a printing mechanism which performs the printing on the plurality of sheets based on a printing data;
- a plurality of trays on which a plurality of sheets printed by the printing mechanism are stackable;
- a discharge mechanism which is configured to discharge the plurality of sheets printed by the printing mechanism on the plurality of trays;
- a plurality of detection mechanisms each of which detects whether a height, in a stacking direction, of the sheets stacked on one of the trays is not less than a threshold value; and
- a controller which controls the discharge mechanism and the printing mechanism,
- the controller being configured that: in a case that the detection mechanisms detect that all heights of the sheets stacked on the plurality of trays are not less than the threshold value, the controller controls the discharge mechanism to discontinue a discharge of the sheets; and

- in a case that after the discharge of the sheets is discontinued and further that the detection mechanisms detect that the heights of the sheets stacked on at least two trays of the plurality of trays became smaller than the threshold value, the controller controls the discharge mechanism to resume the discharge of the sheets on a tray which is other than a tray in which the height of the sheets became smaller than the threshold value last.

According to this printing apparatus, each of the detection mechanisms detects whether the height of the sheets stacked on one of the trays is not less than the predetermined threshold value, and thus it is possible to judge whether more sheets can be discharged on the tray. For example, when paper sheets are used as the sheets, it is possible to detect an error (paper discharge error) indicating a state that it is not possible to further perform the paper discharge onto the tray. Then, when the paper discharge errors are cleared in at least two or more trays, the paper discharge is resumed by discharging the paper sheets on the tray, which is other than the tray in which the paper discharge error is cleared last. Accordingly, it is possible to resume the paper discharge by discharging the paper sheets on the tray, in which it is assumed that the user is not currently working for clearing the paper discharge error. Therefore, it is possible to continue the print process without causing any unfavorable influence to the user's work.

DESCRIPTION OF THE PREFERRED EMBODIMENTS

An explanation will be made below in detail with reference to FIGS. 1 to 5 about an embodiment of the present teaching.

<Structure of Printing Apparatus>

An internal structure of a printing apparatus 100 will be explained with reference to FIG. 1.

Figure 1:
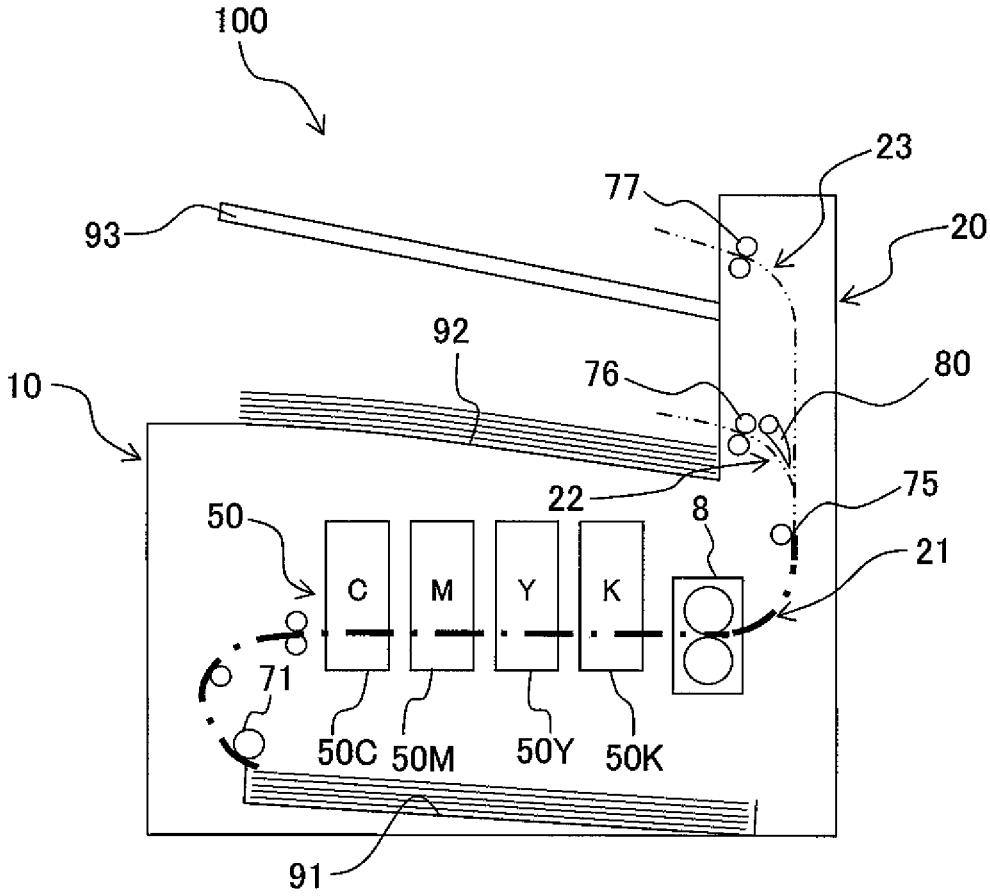
FIG. 1 conceptually shows an internal structure of a printing apparatus according to an embodiment.

As shown in FIG. 1, the printing apparatus 100 is provided with an image printing section 10 which performs printing in an electro photographic manner on a recording medium such as a paper sheet etc., a paper feed tray 91 which accommodates the paper sheets to be printed, and a paper discharge section 20 on which the paper sheets printed by the image printing section 10 are discharged.

The paper discharge section 20 is disposed above the image printing section 10 and is provided with two paper discharge trays including a first paper discharge tray 92 and a second paper discharge tray 93.

The image printing section 10 is provided with a process section 50, which includes four process units 50C, 50M, 50Y, 50K forming toner images of cyan (C), magenta (M), yellow (Y), and black (K) respectively and then transferring the toner images onto the paper sheet. Further, the image printing section 10 is provided with a fixing device 8 which fixes the toner images transferred by the process section 50 on the paper sheet by heating the toner which is not yet fixed while applying pressure on said toner.

The process section 50 forms a color image by overlapping, on the paper sheet, each of the toner images formed by one of the process units 50C, 50M, 50Y, 50K. On the other hand, when a monochrome (black and white) image is formed, the toner image is formed by the process unit 50K only and the printing is performed.

The image printing section 10 takes the paper sheets placed on the paper feed tray 91 one-by-one by a paper feed roller 71, transports the paper sheet to the process section 50, and transfers the toner image formed by the process section 50 onto the paper sheet. The paper sheet on which the toner image is transferred is transported to the fixing device 8 and the toner image is thermally fixed on the paper sheet. Then, the paper sheet on which the toner image is fixed is discharged on the first paper discharge tray 92 or the second paper discharge tray 93.

A transport route 120, which is a substantially S-shaped in cross-section, is provided in the image printing section 10. Various rollers used for transporting the paper sheet (the paper feed roller 71, a resist roller 75, a plurality of pairs of paper discharge rollers 76, 77) and an unillustrated motor for driving these rollers are provided in the transport route 120.

The transport route 120 has a main transport route 21, a first subsidiary transport route 22, and a second subsidiary transport route 23. The main transport route 21 extends from the paper feed tray 91 to the resist roller 75 (depicted by the alternate long and short dash lines in FIG. 1). The first subsidiary transport route 22 extends from the resist roller 75 to the first paper discharge tray 92 (depicted by two-dot lines in FIG. 1). The second subsidiary transport route 23 extends from the resist roller 75 to the second paper discharge tray 93 (depicted by two-dot lines in FIG. 1). Further, a pivotable flapper 80 which switches the transport direction of the paper sheet being transported to guide the paper sheet to any one of the subsidiary transport routes 22, 23 is provided at a branched portion of the main transport route 21 and the subsidiary transport routes 22, 23. The flapper 80 is driven by a solenoid 25 (see FIG. 3) to pivot between a position at which the paper sheet is transported to the first subsidiary transport route 22 and a position at which the paper sheet is transported to the second subsidiary transport route 23. When the paper discharge tray used in the discharge of the paper sheet is specified, a CPU 31 controls the solenoid 25 to pivot the flapper to the position at which the paper sheet is guided to one of the subsidiary transport routes 22, 23 which corresponds to the specified discharge tray. It is noted that it is not indispensable to drive the flapper 80 by the solenoid 25. For example, the flapper 80 may be driven by any other driving mechanism such as an air cylinder.

As described above, the paper sheet taken from the paper feed tray 91 is guided to the first discharge tray 92 via the main transport route 21 and the first subsidiary transport route 22. Or, the paper sheet taken from the paper feed tray 91 is guided to the second paper discharge tray 93 via the main transport route 21 and the second subsidiary transport route 23.

A first paper discharge sensor 60A, which detects whether the first paper discharge tray 92 is full, is provided in the vicinity of a paper discharge port of the first paper discharge tray 92 of the first subsidiary transport route 22. A second paper discharge sensor 60B, which detects whether the second paper discharge tray 93 is full, is provided in the vicinity of a paper discharge port of the second paper discharge tray 93 of the second subsidiary transport route 23. In the present description, an error reporting the following state is referred to as a FULL-ERROR. That is, an amount of the discharged paper sheets has reached a maximum stackable capacity, which is a maximum capacity in which the discharged paper sheets can be stacked on the paper discharge tray, and thus it is not possible to further perform the paper discharge onto said paper discharge tray.

Next, a construction of the first paper discharge sensor 60A will be explained with reference to FIGS. 2A and 2B.

Figure 2B:
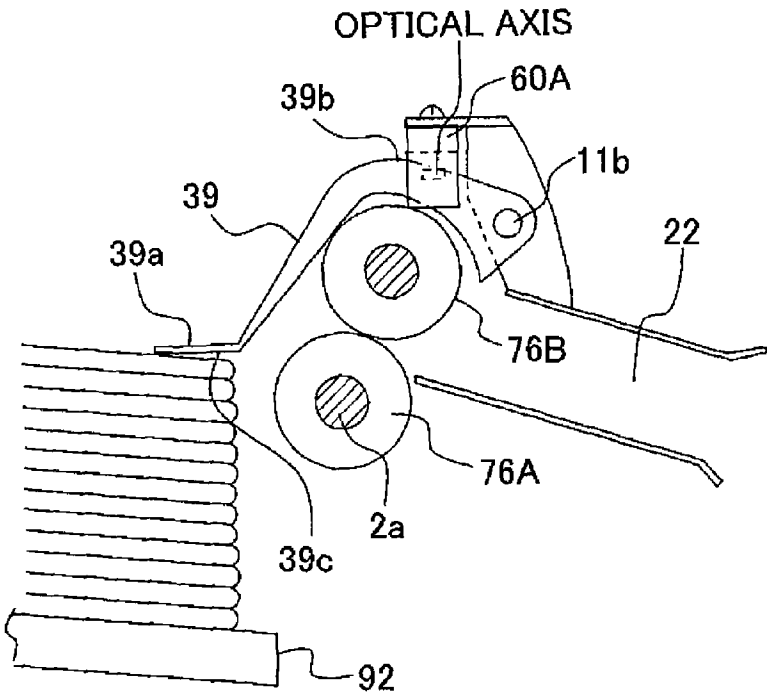
FIGS. 2A and 2B are enlarged views each showing the vicinity of a paper discharge port of a paper discharge tray of the printing apparatus shown in FIG. 1, FIG. 2A showing a state that an amount of paper sheets discharged on the paper discharge tray is below a maximum stackable capacity, FIG. 2B showing a state that the amount of the paper sheets discharged on the paper discharge tray has reached the maximum stackable capacity.
Figure 2A:
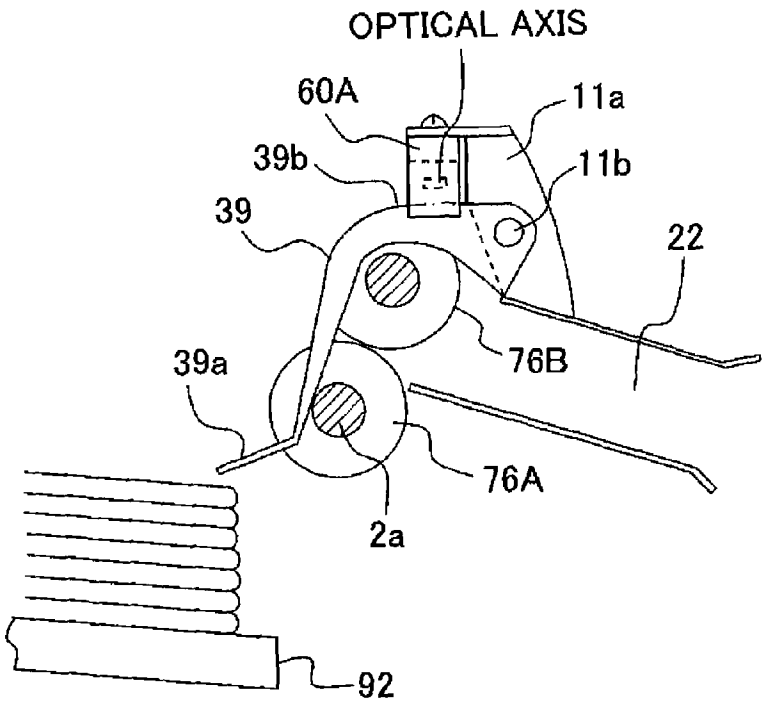

As shown in FIG. 2A, a bending-rising portion 11*a* extending toward an upper side of FIG. 2A is provided at a tip portion of an upper-side paper guide plate 11 defining the first subsidiary transport route 22. A shaft 11*b* is provided at a substantial center portion of the bending-rising portion 11*a*. A paper detector 39 is rotatably provided in the shaft 11*b*, with the shaft 11*b* as a rotation center. The first paper discharge sensor 60A is provided at the tip portion of the bending-rising portion 11*a*. The paper detector 39 includes an arm portion 39*b* having a substantially L-shaped, which is rotatably fixed to the shaft 11*b* at one end thereof, and an end portion 39*a* projecting from a tip portion of the arm portion 39*b* disposed on the side opposite to the shaft 11*b* toward the first paper discharge tray 92. Further, a surface of the end portion 39*a* which makes contact with the paper sheets discharged on the first paper discharge tray 92 is referred to as an end surface 39*c*. The first paper discharge sensor 60A includes an unillustrated light-emitting element and an unillustrated light-receiving element. The arm portion 39*b* of the paper detector 39 is swingably provided between the light-emitting element and the light-receiving element. When there is no paper sheet between the pair of paper discharge rollers 76, the end portion 39*a* of the paper detector 39 is stationary by the self-weight and by using a shaft portion 2*a* of a paper discharge roller 76A as a stopper. In this situation, the arm portion 39*b* of the paper detector 39 is provided so that an optical axis of the first paper discharge sensor 60A is not blocked. In FIGS. 2A and 2B, only one pair of the paper discharge rollers 76A, 76B is illustrated. However, a plurality of pairs of the paper discharge rollers 76A, 76B are aligned in an extending direction of the shaft portion 2*a* with a predetermined spacing distance therebetween. The first paper discharge sensor 60A is provided at a position different from the paper discharge rollers 76A, 76B in the extending direction of the shaft portion so that the first paper discharge sensor 60A does not contact with the paper discharge rollers 76A, 76B. The paper detector 39 may be disposed at the center in an extending direction of the paper discharge roller 76A (a direction perpendicular to the moving direction of the paper sheet to be discharged). In this case, the paper detector 39 can be brought in contact with the paper sheet irrespective of the type (size) of the paper sheet. Especially, this configuration is preferable when the paper sheet is discharged in a state of being closer to the center of the first paper discharge tray 92. Alternatively, when the paper sheet is discharged in a state of being closer to one side in the extending direction of the paper discharge roller 76A, the paper detector 39 may be disposed at said one side in the extending direction of the paper discharge roller 76A.

When the paper sheets each transported from the paper feed tray 91 are stacked on the first paper discharge tray 92 to a certain height, the end surface 39*c* of the paper detector 39 becomes in a state of being lifted upwardly, thereby blocking the optical axis of the first paper discharge sensor 60A by the arm section 39*b* of the paper detector 39 as shown in FIG. 2B. In this case, when the optical axis remains blocked after a certain period of time was elapsed, the first paper discharge sensor 60A sends a FULL-ERROR signal to the CPU 31 (see FIG. 3). When the CPU 31 receives the FULL-ERROR signal from the first paper discharge sensor 60A, the CPU 31 judges that the FULL-ERROR occurs in the first paper discharge tray 92.

The second paper discharge sensor 60B provided in the vicinity of the paper discharge port of the second paper discharge tray 93 has the same structure of that of the first paper discharge sensor 60A, and thus the description thereof is omitted.

<Electrical Construction of Printing Apparatus>

Figure 3:
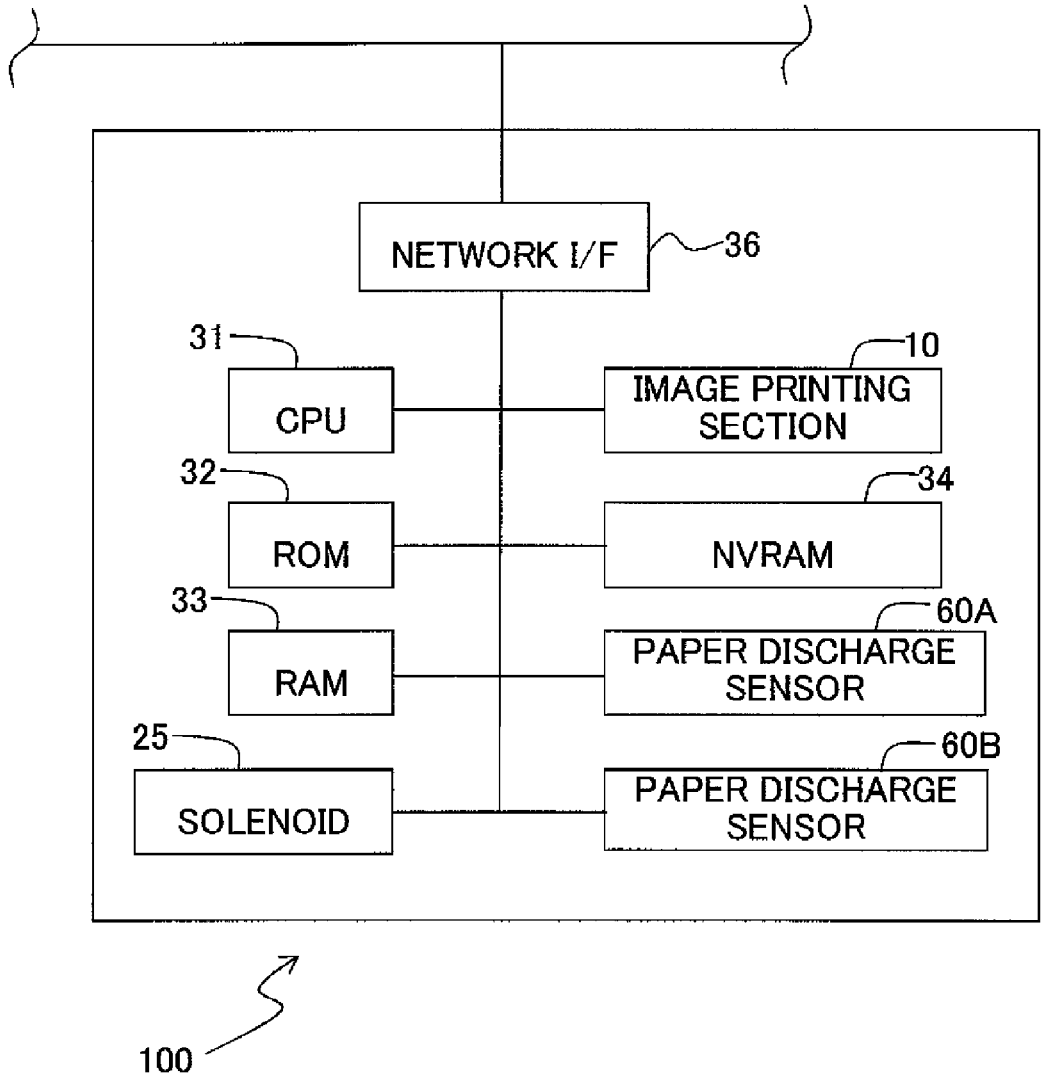
FIG. 3 is a block diagram showing an electrical structure of the printing apparatus shown in FIG. 1.

Subsequently, an electrical construction of the printing apparatus 100 will be described. As shown in FIG. 3, the printing apparatus 100 includes the CPU 31, a ROM 32, a RAM 33, a NVRAM (non-volatile RAM) 34, a network interface 36, the solenoid 25, and the first and second paper discharge sensors 60A, 60B.

In the ROM 32, various control programs, various settings for controlling the printing apparatus 100, and an initial value, etc., are stored.

The RAM 33 is used as an operation area for performing an operation for reading out the variety of kinds of control programs, for temporarily storing a print data, for performing an operation for analyzing a print data written in PDL (page description language) and expanding the print data into a bit map image, etc.

The CPU 31 controls the respective constitutive parts or components of the printing apparatus 100 in accordance with the control programs read out from the ROM 32 and/or signals transmitted from the various sensors, while storing the result of processing in the RAM 33 or NVRAM 34.

The network interface 36 is connected to a communication line such as a LAN and enables connection with respect to an external apparatus such as a computer into which a driver for the printing apparatus 100 is installed. The printing apparatus 100 is capable of performing exchange of print data via the network interface 36.

<Printing Operation>

Subsequently, a printing operation of the printing apparatus 100 will be explained by focusing attention on a paper discharge process for discharging the paper sheet subjected to printing. The printing apparatus 100 has a function in which the paper discharge tray (hereinafter referred to as a discharge target tray which is a tray to be subjected to the paper discharge) is automatically switched between the first paper discharge tray 92 and the second paper discharge tray 93 in accordance with a priority order of the paper discharge. In this automatic switching function, even when the FULL-ERROR occurs in the discharge target tray, when the FULL-ERROR does not occur in the other paper discharge tray, the discharge target tray is automatically switched to said other paper discharge tray to continue the printing. However, when the FULL-ERRORs occur in both of the paper discharge trays, the printing is discontinued. When the FULL-ERRORs of both of the paper discharge trays are cleared by the user, the paper discharge tray in which the FULL-ERROR is cleared first is made to be a first priority tray to be subjected to the paper discharge, and the printing is resumed.

<Print Control Process>

Figure 4A:
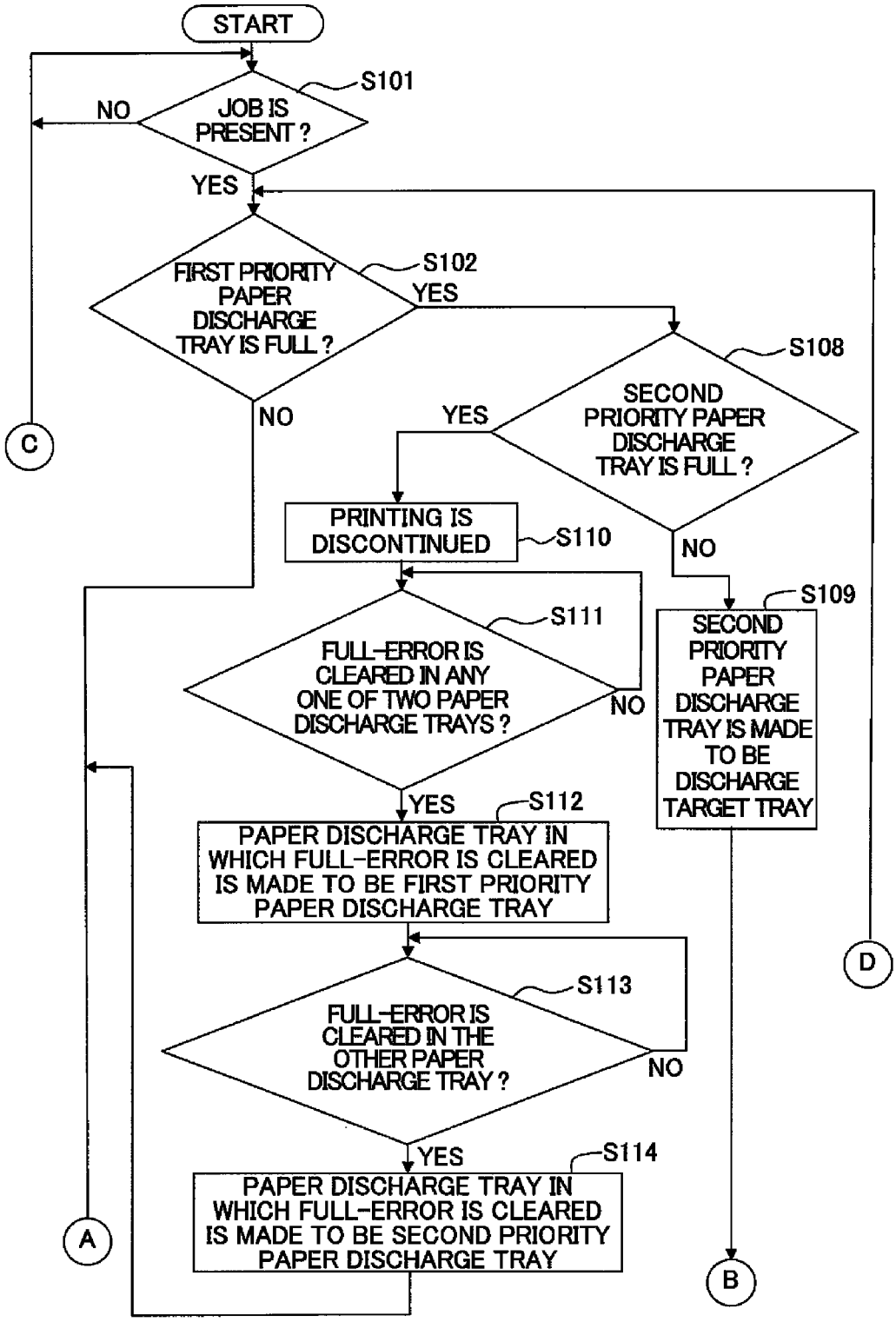
FIGS. 4A and 4B show a flowchart showing a procedure of a print control process according to the embodiment.
Figure 4B:
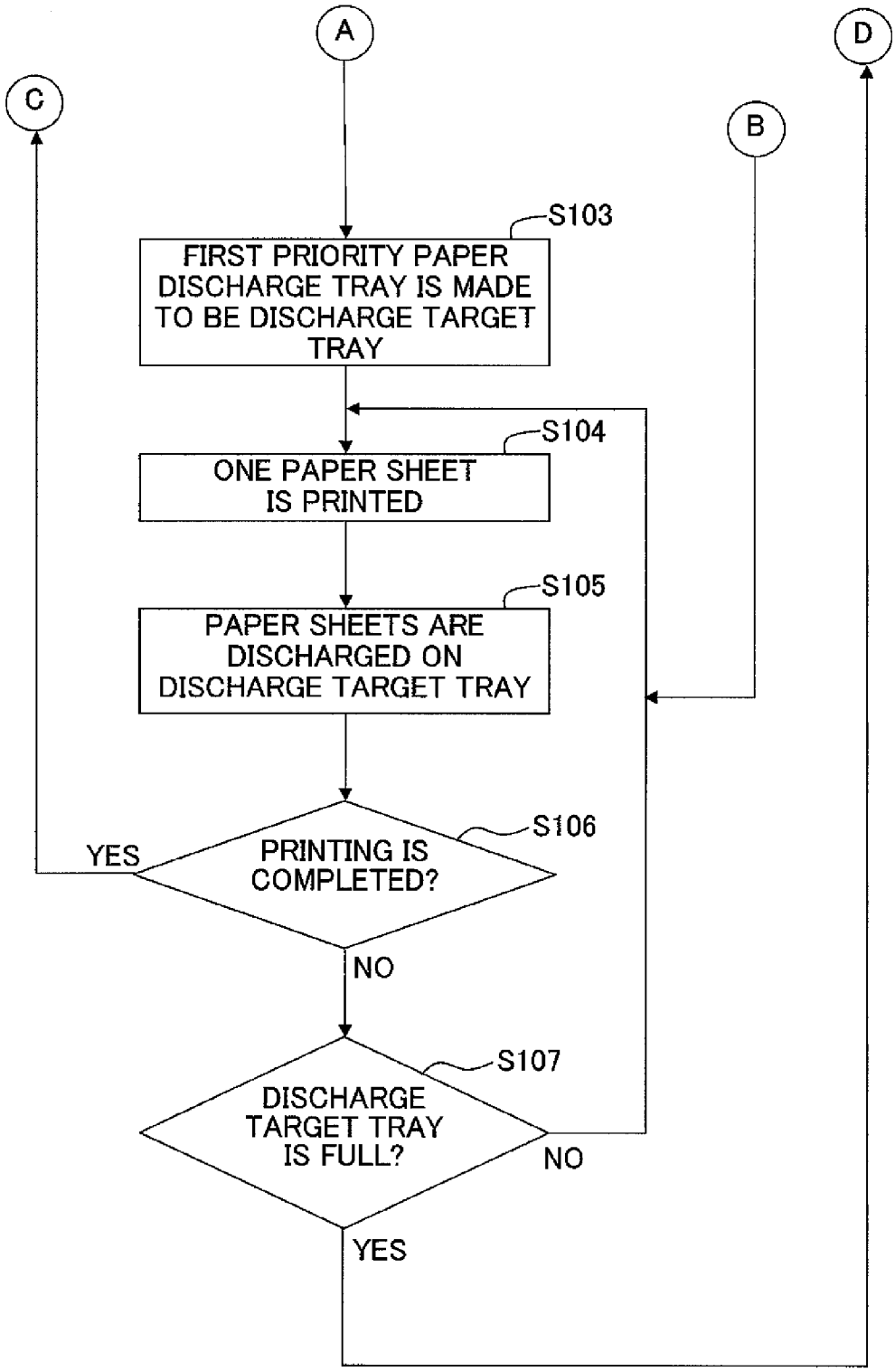

Hereinbelow, a procedure of a print control process of the printing apparatus 100, which realizes the printing operation described above, will be explained with reference to a flowchart of FIGS. 4A and 4B. The print control process is a process which is performed repeatedly while the printing apparatus 100 is turned on. According to a default setting of the automatic switching function of the printing apparatus 100, the priority order of the paper discharge is an order from the first paper discharge tray 92 to the second paper discharge tray 93. The priority order of the paper discharge is stored in the RAM 33.

At first, the printing apparatus 100 becomes a stand-by state when the power is switched on. Subsequently, the CPU 31 judges whether or not a printing job is received via the network interface 36 (S101). When the CPU 31 judges that the printing job is not received (S101: NO), the CPU 31 waits until the printing job is received. When the CPU 31 judges that the printing job is received (S101: YES), the printing job is once stored in the RAM 33.

Next, the CPU 31 judges, based on the priority order of the paper discharge stored in RAM 33, whether or not the FULL-ERROR occurs in the first priority paper discharge tray (S102). Here, whether or not the FULL-ERROR occurs in the paper discharge tray is judged based on output signals of the first and second paper discharge sensors 60A, 60B provided in the respective paper discharge trays.

When the CPU 31 judges that the FULL-ERROR occurs in the first priority paper discharge tray (S102: YES), the process proceeds to a process to judge as to whether or not the FULL-ERROR occurs in a second priority paper discharge tray (S108). On the other hand, when the CPU 31 judges that the FULL-ERROR does not occur in the first priority paper discharge tray (S102: NO), this first priority paper discharge tray is made to be the discharge target tray (S103). An image is printed on one paper sheet based on the printing job received in S101 (S104), and then the one paper sheet is discharge on said discharge target tray (S105).

Then, the CPU 31 judges whether or not the print process of the printing job is completed (S106). When the print process of the printing job is completed (S106: YES), the process is returned to S101 and the CPU 31 waits until a new printing job is received.

On the other hand, when the print process of the printing job is not completed (S106: NO), the CPU 31 judges whether or not the FULL-ERROR is caused in the discharge target tray by the paper discharge in S105 (S107). When the FULL-ERROR does not occur in the discharge target tray (S107: NO), the print process of the printing job is completed by the CPU 31 or the process ranging from the S104 to S107 is performed repeatedly by the CPU 31 until the FULL-ERROR occurs in the discharge target tray. When the FULL-ERROR occurs in the discharge target tray (S107: YES), the process is returned to S102.

Further, the CPU 31 judges, based on the priority order of the paper discharge stored in the RAM 33, whether or not the FULL-ERROR occurs in the second priority paper discharge tray (S108). When the CPU 31 judges that the FULL-ERROR does not occur in the second priority paper discharge tray (S108: NO), the second priority paper discharge tray is made to be the discharge target tray (S109), and the process is shifted to S104.

On the other hand, when the CPU 31 judges that the FULL-ERROR occurs in the second priority paper discharge tray, that is, the FULL-ERRORs occur in both of the first priority paper discharge tray and the second priority paper discharge tray (S108: YES), the print process is discontinued and the CPU 31 waits until the FULL-ERRORs of both of the paper discharge trays are cleared (S110). In this situation, the CPU 31 may report, to the user, that the printing is discontinued due to the FULL-ERRORs of both of the paper discharge trays.

In that case, the CPU 31 judges whether or not the FULL-ERROR is cleared in any one of the two paper discharge trays (S111). The print process is discontinued until the FULL-ERROR is cleared in any one of the two paper discharge trays (S111: NO).

Further, when the CPU 31 judges that the FULL-ERROR is cleared in any one of the two paper discharge trays (S111: YES), said paper discharge tray in which the FULL-ERROR is cleared is made to be the first priority paper discharge tray (S112). Here, the priority order of the paper discharge stored in the RAM 33 may be updated.

Next, the CPU 31 judges whether or not the FULL-ERROR of the other paper discharge tray is cleared (S113). The print process is discontinued until the FULL-ERROR of the other paper discharge tray is cleared (S113: NO).

When the CPU 31 judges that the FULL-ERROR of the other paper discharge tray is cleared, that is, the paper discharge can be performed on both of the paper discharge trays (S113: YES), the other paper discharge tray is made to be the second priority paper discharge tray (S114). Here, the priority order of the paper discharge stored in the RAM 33 is updated. Then, the process is returned to S103, and the print process is resumed.

Accordingly, the priority order of the paper discharge, which is stored in the RAM 33 during a period of time after the print process is discontinued and before the print process is resumed, corresponds to a descending order of the tray starting from the tray in which the FULL-ERROR is cleared first.

Exemplary Embodiment

Hereinbelow, an exemplary embodiment of the print control process in FIGS. 4A and 4B will be explained with reference to FIGS. 5A to 5G.

Figure 5C:
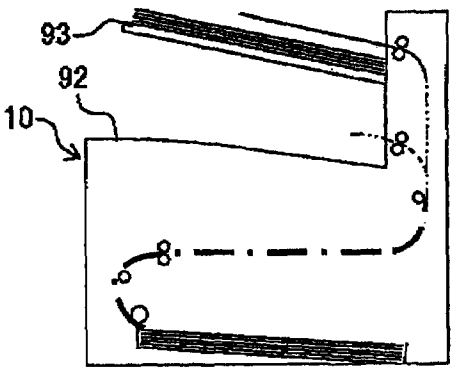
FIG. 5A to FIG. 5G are state transition diagrams each showing an exemplary embodiment of the print control process according to the embodiment.

At first, it is assumed that the CPU 31 judged the paper discharge can be performed on both of the paper discharge trays in an initial state which is immediately after the printing apparatus 100 is turned on (S102: NO). In this situation, as shown in FIG. 5A, the first paper discharge tray 92, which is first priority paper discharge tray, is made to be the discharge target tray by the CPU 31, in accordance with the priority order of the paper discharge of the default setting stored in the RAM 33 (S103). The paper sheet on which the images according to the printing job received by the CPU 31 has been printed is discharged on the first paper discharge tray 92 (S104, S105). The CPU 31 continues to discharge each paper sheet, on which the images according to the printing job received by the CPU 31 has been printed, on the first paper discharge tray 92 (S104, S105) until the FULL-ERROR occurs in the first paper discharge tray 92 (S107: NO).

Figure 5B:
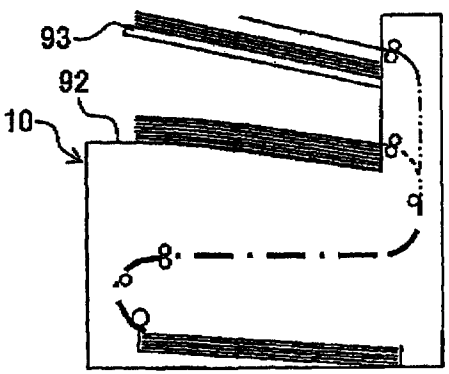
Figure 5A:
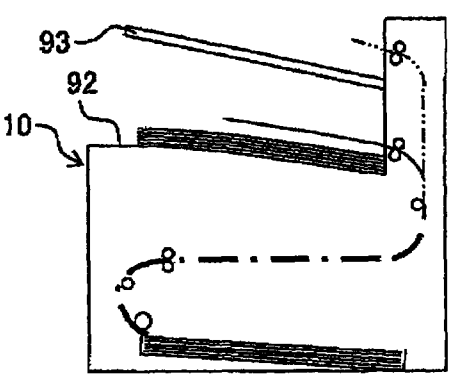

Next, as shown in FIG. 5B, when the FULL-ERROR occurs in the first paper discharge tray 92 (S107: YES), the discharge target tray is switched from the first paper discharge tray 92 to the second paper discharge tray 93 (S109) by the CPU 31, in accordance with the priority order of the paper discharge of the default setting (S102: YES, S108: NO). Then, the paper sheet on which the images according to the printing job received by the CPU 31 has been printed is discharged on the second paper discharge tray 93 (S104, S105). The CPU 31 continues to discharge each paper sheet, on which the images according to the printing job received by the CPU 31 has been printed, on the second paper discharge tray 93 (S104, S105) until the FULL-ERROR occurs in the second paper discharge tray 93 (S107: NO).

Further, as shown in FIG. 5C, even when the FULL-ERROR of the first paper discharge error 92 is cleared by the user during the paper discharge onto the second paper discharge tray 93 (S107: NO), the CPU 31 continues the paper discharge on the second paper discharge tray 93 as it is (S104, S105). When it is judged that the FULL-ERROR occurs in the second paper discharge tray 93 (S107: YES, S102: NO), the discharge target tray is switched from the second paper discharge tray 93 to the first paper discharge tray 92 (S103). Then, the paper sheet on which the printing job received by the CPU 31 has been printed is discharged on the first paper discharge tray 92 (S104, S105).

Figure 5D:
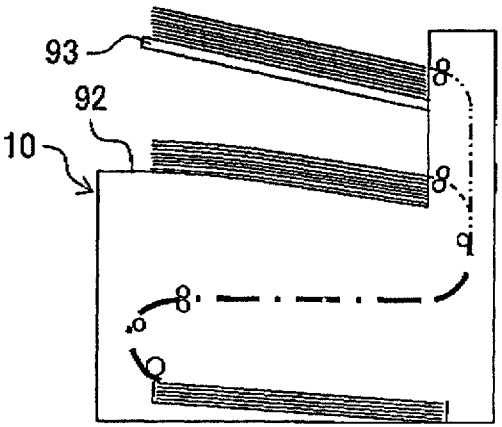

On the other hand, when the CPU 31 judges that the FULL-ERRORs occur in both of the first paper discharge tray 92 and the second paper discharge tray 93 (S102: YES, S108: YES), the print process is discontinued (S110) and the CPU 31 waits until the FULL-ERRORs of both of the paper discharge trays are cleared, as shown in FIG. 5D.

Figure 5E:
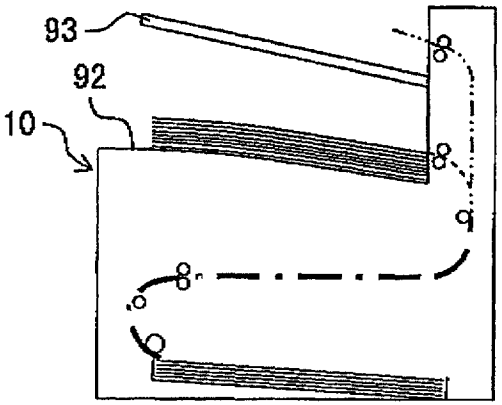

In this situation, even when the FULL-ERROR of the second paper discharge tray 93 is cleared by the user (S111: YES), the CPU 31 does not resume the print process and the second paper discharge tray 93 is made to be the first priority paper discharge tray (S112), as shown in FIG. 5E.

Figure 5F:
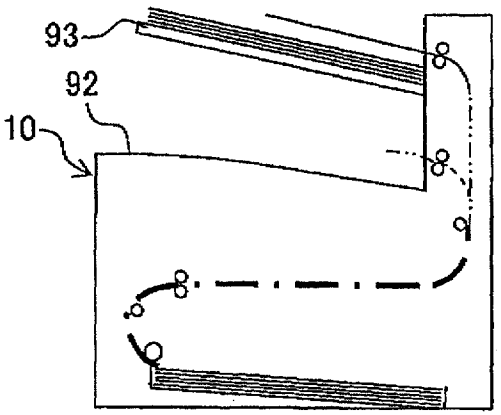

Then, as shown in FIG. 5F, when the FULL-ERROR of the first paper discharge tray 92 is also cleared by the user (S113: YES), the first paper discharge tray 92 is made to be the second priority paper discharge tray (S114). That is, the priority order of the paper discharge stored in the RAM 33 is changed to the order from the second paper discharge tray 93 to the first paper discharge tray 92.

The first priority paper discharge tray is made to be the discharge target tray by the CPU 31 (S103) in accordance with the latest priority order stored in the RAM 33 (S102: NO). That is, in FIG. 5F, the second paper discharge tray 93 in which the FULL-ERROR is cleared first is made to be the discharge target tray, and the printing is resumed.

Figure 5G:
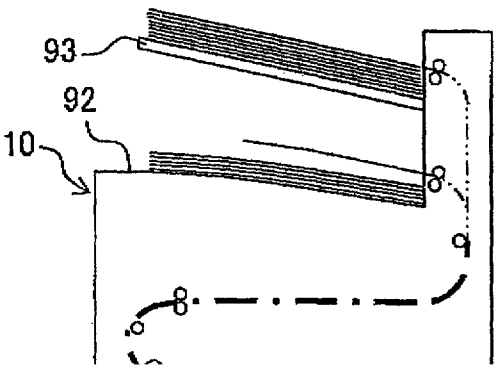

When the FULL-ERROR recurs in the second paper discharge tray 93 (S107: YES), as shown in FIG. 5G, the discharge target tray is switched from the second paper discharge tray 93 to the first paper discharge tray 92 by the CPU 31 (S109) in accordance with the latest priority order (S102: YES, S108: NO). Then, the paper sheet on which the printing job received by the CPU 31 has been printed is discharged on the first paper discharge tray 92 (S104, S105).

Effect of the Embodiment

According to the print control process described above, when the print process is discontinued due to the FULL-ERRORs occurred in both of the paper discharge trays, and when the FULL-ERRORs of both of the paper discharge trays are cleared, the CPU 31 resumes the print process. Further, the priority order of the paper discharge with respect to both of the paper discharge trays is determined based on the descending order starting from the tray in which the FULL-ERROR is cleared first, and the paper discharge is resumed based on said priority order of the paper discharge.

According to this embodiment, the print process is resumed so that the paper discharge tray, which is at least other than the paper discharge tray in which the FULL-ERROR is cleared last, is made to be the first priority. Here, it can be assumed that the user is not currently working for clearing the FULL-ERROR in the paper discharge tray other than the paper discharge tray in which the FULL-ERROR is cleared last. By resuming the print process so that the paper discharge tray other than the paper discharge tray in which the FULL-ERROR is cleared last is made to be the first priority, it is possible to continue the print process without causing, to the user's work, any unfavorable influence due to the resumption of the print process.

Further, it is assumed that the user is much less likely to be working for clearing the FULL-ERROR in the paper discharge tray in which the FULL-ERROR is cleared first. According to this embodiment, the print process is resumed by using the paper discharge tray in which the FULL-ERROR is cleared first. Thus it is possible to reduce possibility that the resumption of the print process has any unfavorable influence on the user's work.

Further, after the resumption of the print process, when the FULL-ERROR recurs in the paper discharge tray, and when the print process is continued by switching the discharge target tray from the paper discharge tray in which the FULL-ERROR is cleared first to the paper discharge tray in which the priority order of the paper discharge is low, any unfavorable influence is more likely to be brought about on the user's work. According to this embodiment, after the resumption of the print process, the discharge target tray is switched based on the priority order of the paper discharge to discharge the paper sheet subjected to printing. By doing so, it is possible to delay the paper discharge on the paper discharge tray in which the user is more likely to be working for clearing the FULL-ERROR. Accordingly, since the discharge target tray is switched to continue the print process, it is possible to reduce the possibility that any unfavorable influence is brought about on the user's work.

Other Embodiment

It is noted that this embodiment is provided merely as an example, and the present teaching is not limited thereto. Therefore, it is needless to say that various modifications which fall within the basic teaching herein set forth may be made to the present teaching.

In the above embodiment, the present teaching is applicable, without being limited to the printing apparatus, to those which include a plurality of paper discharge trays, such as copy machines, multifunction machines, etc. Further, the image forming type of the process section 50 may be an ink jet type without being limited to the electro-photographic type.

Further, in the above embodiment, the paper discharge section 20 includes the two paper discharge trays. However, the paper discharge tray 20 may include three or more paper discharge trays. In such a construction, when the FULL-ERRORs occur in all of the three or more paper discharge trays, the print process is discontinued by the CPU 31. After the FULL-ERRORs of at least two or more paper discharge trays are cleared, the print process is resumed.

In this case, similar to the above embodiment, it is allowable that the paper discharge tray in which the FULL-ERROR is cleared first is made to be the first priority paper discharge tray and that the paper discharge tray in which the FULL-ERROR is cleared second is made to be the second priority paper discharge tray. That is, the priority order of the paper discharge may be determined in accordance with the descending order of the paper discharge tray starting from the tray in which the FULL-ERROR is cleared first.

However, the present teaching is not limited to this manner. The priority order of the paper discharge may be determined in accordance with any manner, provided that the print process is resumed so that the paper discharge tray, which is at least other than the paper discharge tray in which the FULL-ERROR is cleared last, is made to be the first priority paper discharge tray. For example, the print process may be resumed so that the paper discharge tray in which the FULL-ERROR is cleared first is made to be the first priority paper discharge tray. In this case, the priority order of the paper discharge with respect to each paper discharge tray, which follows the paper discharge tray in which the FULL-ERROR is cleared first, may be arbitrarily determined.

Further, when the FULL-ERRORs occur in all of the three or more paper discharge trays, the CPU 31 is also capable of executing the following process. That is, the print process is not resumed unless the FULL-ERRORs of all of the paper discharge trays are cleared.

Further, in the above embodiment, the print process is discontinued when the FULL-ERROR is detected. However, another configuration is also available, in which a JAM-ERROR is detected in addition to the detection of the FULL-ERROR. The paper detector 39 in the above embodiment can be utilized as a jam sensor. For example, when the paper jam occurs at the pair of paper discharge rollers 76 while the paper sheet is passing through the pair of paper discharge rollers 76, the front-end of the paper sheet reaches the paper detector 39 in a state of being intervened between the pair of paper discharge rollers 76 in some cases. In such a case, the end portion 39*a* of the paper detector 39 makes contact with the paper sheet to pivotably move the arm portion 39*b* thereby blocking the optical axis of the first paper discharge sensor 60A. When the arm portion 39*b* continues to block the optical axis of the first paper discharge sensor 60A over a predetermined time, it is judged that discharge failure of the paper sheet (FULL-ERROR or JAM ERROR) occurs in the first paper discharge tray 92. Further, it is allowable that a plurality of jam sensors (for example, optical sensors) for detecting the paper jam are provided in the first subsidiary transport route 22 and the second subsidiary transport route 23, respectively. The jam sensor outputs a detection signal to the CPU 31, when occurrence of the paper jam is detected while the paper sheet subjected to printing is transported in the first subsidiary transport route 22 or the second subsidiary transport route 23. Accordingly, the CPU 31 is capable of judging on which paper discharge tray the paper jam occurs, based on the detection signal. When the above JAM-ERROR occurs, it is also possible to judge whether the discharge failure of the paper sheet occurred in the first paper discharge tray 92 is caused by the FULL-ERROR or the JAM-ERROR by combining the paper detector 39 and the jam sensor disposed at the first subsidiary transport route 22.

According to this construction, it is possible to continue the print process without causing any unfavorable influence on a user's work by resuming the print process so that the paper discharge tray, in which the user is not working for clearing the paper jam just before the print process is resumed, is made to be the first priority paper discharge tray. In a printing apparatus which is capable of detecting both the FULL-ERROR and the JAM-ERROR, when at least any one of the errors occurs in the paper discharge tray and when it is judged that the error occurs in said paper discharge tray, the print control process of the above embodiment may be executed.

Figure 6:
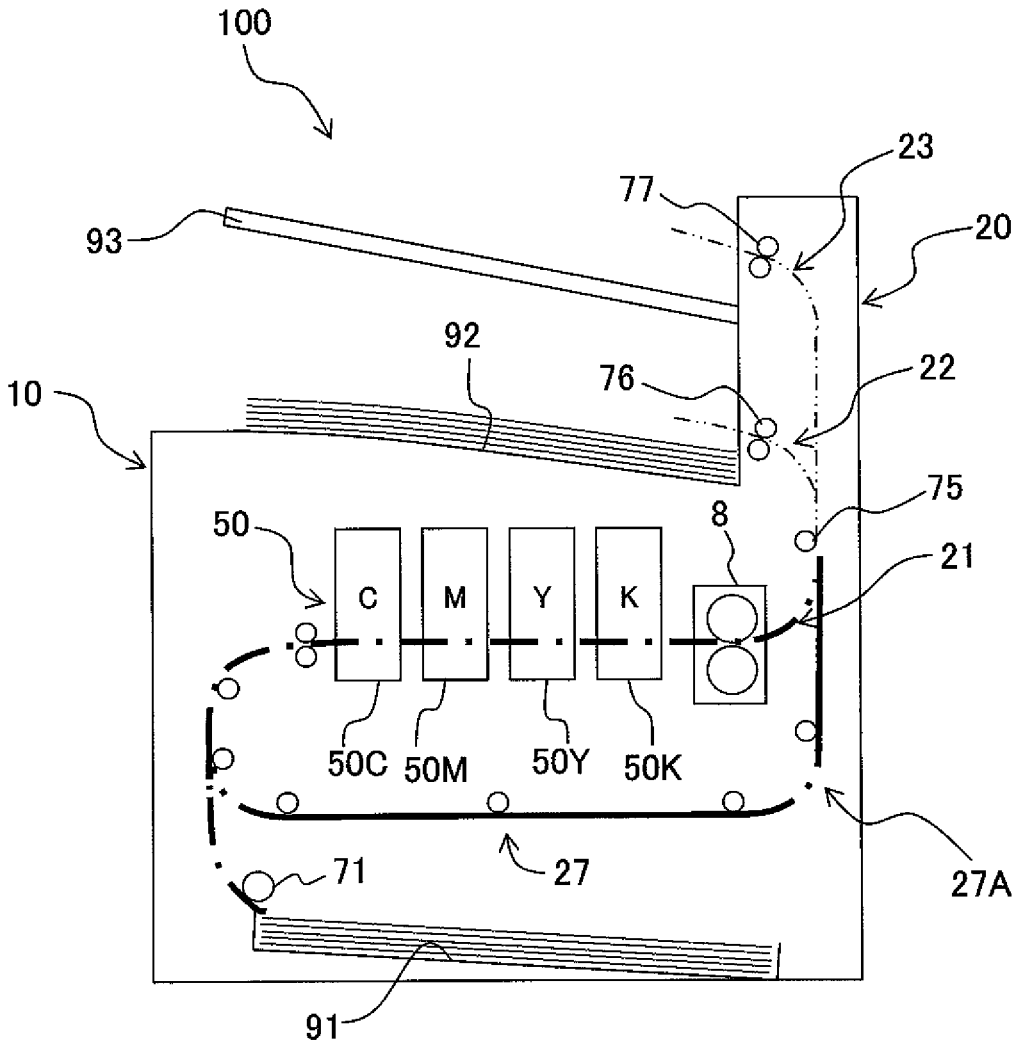
FIG. 6 conceptually shows an internal structure of a printing apparatus having a double-sided printing system.

Further, in the above embodiment, the transport route having the substantially S-shaped is provided in the printing apparatus 100. In addition to this, as shown in FIG. 6, the printing apparatus 100 may include a double-sided printing system 27 in which a double-sided printing transport route 27A is formed. The double-sided printing system 27 is a system in which the paper sheet that has been printed on one surface thereof is reversed and then transported to the image printing section 10 to perform the printing on the other surface thereof. It is possible to use a conventional double-sided printing system as the double-sided printing system 27, therefore a detailed explanation regarding the configuration thereof is omitted. If the double-sided printing transport route 27A is provided in the printing apparatus 100, even with respect to the printing job of a single-sided printing, it is allowable that the first paper sheet subjected to printing is passed through the double-sided printing transport route 27A and is discharge on the paper discharge tray, which is other than the paper discharge tray in which the FULL-ERROR is cleared last. According to this construction, the first paper sheet subjected to printing, which is discharged after the resumption of the print process, is discharged slower than usual. Thus, it is possible to further reduce the possibility that any unfavorable influence is brought about on a user's work, as compared with a case in which the paper sheet is discharged without passing through the reversing path. Further, the operation in which the paper sheet is passed through the reversing path is recognized by the user, so that it is possible to notify the user the resumption of the print process.

What is claimed is:

1. A printing apparatus which performs a printing on a plurality of sheets, comprising:

a printing mechanism which performs the printing on the plurality of sheets based on a printing data;

a plurality of trays on which a plurality of sheets printed by the printing mechanism are stackable;

a discharge mechanism which is configured to discharge the plurality of sheets printed by the printing mechanism on the plurality of trays;

a plurality of detection mechanisms each of which detects whether a height, in a stacking direction, of the sheets stacked on one of the trays is not less than a threshold value; and a controller which controls the discharge mechanism and the printing mechanism, wherein in a case that the detection mechanisms detect all heights of the sheets stacked on the plurality of trays to be not less than the threshold value, the controller controls the discharge mechanism to discontinue a discharge of the sheets; and in a case that, after the discharge of the sheets is stopped, the detection mechanisms detect the heights of the sheets stacked on at least two trays of the plurality of trays to be smaller than the threshold value, the controller controls the discharge mechanism to resume the discharge of the sheets on a tray which is other than a tray in which the height of the sheets became smaller than the threshold value last.

2. The printing apparatus according to claim 1, further comprising an order memory which stores a descending order of the trays detected by the detection mechanisms and starting from a tray in which the height of the sheets became smaller than the threshold value first, wherein the controller controls the discharge mechanism to resume the discharge of the sheets from the tray in which the height of the sheets became smaller than the threshold value first.

3. The printing apparatus according to claim 2, wherein in a case that one of the detection mechanisms detects a height of the sheets stacked on one of the trays after a resumption of the discharge of the sheets to be not less than the threshold value, the controller controls the paper discharge mechanism so that the one of the trays is switched to a tray, in which the height of the sheets became smaller than the threshold value second, to discharge the sheets, based on the descending order stored in the order memory.

4. The printing apparatus according to claim 1, wherein each of the detection mechanisms is configured so that the error is detected in a case that an amount of sheets stacked on one of the trays reaches a maximum number of sheets to be stacked or in a case that at least one sheet of the sheets subjected to the printing causes a jam.

5. The printing apparatus according to claim 1, further comprising a reversing mechanism which is configured to reverse a front surface and a back surface of each of the sheets printed by the printing mechanism, wherein in a case that the detection mechanisms detect the heights of the sheets to be smaller than the threshold value in at least two or more trays of the plurality of trays, the controller controls the discharge mechanism so that a first sheet of the sheets is discharged, by passing through the reversing mechanism, on the tray which is other than the tray in which the height of the sheets became smaller than the threshold value last.

6. The printing apparatus according to claim 1, wherein the discharge mechanism includes, corresponding to the plurality of trays, a plurality of guide plates each defining a transporting route through which the sheets printed by the printing mechanism are transported toward one of the trays, and a plurality of pairs of discharge rollers each of which is arranged between one end of one of the guide plates and one of the trays to discharge the sheets printed by the printing mechanism, each of the detection mechanisms includes: an optical sensor having a light-emitting portion and a light-receiving portion; and an arm section which is configured to be swingable in accordance with the height of the sheets stacked on one of the trays, one end of the arm section is a contacting portion which is configured to contact with the sheets stacked on the one of the trays, and the other end of the arm section is a swinging portion which is attached to the one of the guide plates swingably, and the light-emitting portion and the light-receiving portion are arranged to sandwich the arm portion so that the arm portion blocks a light traveling from the light-emitting portion to the light-receiving portion, under a condition that the height of the sheets stacked on the one of the trays is not less than the threshold value.

7. The printing apparatus according to claim 6, wherein each of the detection mechanisms detects that the sheets stacked on one of the trays are not less than the threshold value, under a condition that the arm portion continues to block the light over a predetermined time period.

8. The printing apparatus according to claim 6, wherein each of the detection mechanisms is arranged at a substantially center region of one of the trays in a direction of a rotational axis of one of the discharge roller pairs.

9. A printing apparatus which performs a printing on a plurality of sheets, comprising:

a printing mechanism which performs the printing of an image on a sheet of the plurality of the sheets based on a printing data;

a first tray on which a plurality of sheets printed by the printing mechanism are stackable;

a second tray on which a plurality of sheets printed by the printing mechanism are stackable;

a first detection mechanism which detects whether a first height, in a stacking direction, of the sheets stacked on the first tray is not less than a first threshold value;

a second detection mechanism which detects whether a second height, in a stacking direction, of the sheets stacked on the second tray is not less than a second threshold value;

a discharge mechanism which is configured to discharge the sheets printed by the printing mechanism on the first tray or the second tray selectively; and a controller which controls the discharge mechanism and the printing mechanism, wherein in a case that the first and second detection mechanisms detect the first and second heights of the sheets are not less than the first and second threshold values, respectively, the controller controls the discharge mechanism to stop a discharge of the sheets; and in a case that, after the discharge of the sheets is stopped, the first detection mechanism detects the first height of the sheets to be smaller than the first threshold value and then the second mechanism detects the second height to be smaller than the second threshold value, the controller controls the discharge mechanism to start the discharge of the sheets on the first tray.

10. The printing apparatus according to claim 9, further comprising a reversing mechanism which is configured to reverse a front surface and a back surface of each of the sheets printed by the printing mechanism, wherein in a case that the first and second detection mechanisms detect the first and second heights of the sheets to be smaller than the first and second threshold values, respectively, the controller controls the discharge mechanism so that a first sheet of the sheets is discharged, by passing through the reversing mechanism, on one of the first and second trays in which a height of the sheets became smaller than one of the first and second threshold values last.

11. The printing apparatus according to claim 9, wherein the discharge mechanism includes, corresponding to the first and second trays, a first and second guide plates defining transporting routes through which the sheets printed by the printing mechanism are transported toward the first and second trays, respectively, and a first and second pairs of discharge rollers each of which is arranged between one end of one of the first and second guide plates and one of the first and second trays to discharge the sheets printed by the printing mechanism, each of the first and second detection mechanisms includes: an optical sensor having a light-emitting portion and a light-receiving portion; and an arm section which is configured to be swingable in accordance with the height of the sheets stacked on one of the first and second trays, one end of the arm section is a contacting portion which is configured to contact with the sheets stacked on the one of the first and second trays, and the other end of the arm section is a swinging portion which is attached to the one of the first and second guide plates swingably, and the light-emitting portion and the light-receiving portion are arranged to sandwich the arm portion so that the arm portion blocks a light traveling from the light-emitting portion to the light-receiving portion, under a condition that the height of the sheets stacked on the one of the first and second trays is not less than one of the first and second threshold value, respectively.

12. The printing apparatus according to claim 11, wherein the first and second detection mechanisms detects that the sheets stacked on the first and second trays are not less than the first and second threshold values, respectively, under a condition that the arm portion continues to block the light over a predetermined time period.

13. The printing apparatus according to claim 11, wherein the first and second detection mechanisms are arranged at a substantially center region of the first and second trays in a direction of a rotational axis of the first and second discharge roller pairs, respectively.

* * * * *